United States Patent [19]
Minor et al.
[11] 4,002,956
[45] Jan. 11, 1977

[54] AUTOMATIC ELECTRONIC LOCK OFF SYSTEM FOR AN APPLIANCE

[76] Inventors: Ross D. Minor; Cleta M. Minor, both of 1348 E. 11th St., Tulsa, Okla. 74120

[22] Filed: June 6, 1975

[21] Appl. No.: 584,599

[52] U.S. Cl. ..... 317/154; 340/280; 307/142

[51] Int. Cl.² ..... H01H 47/04

[58] Field of Search ..... 340/280, 248 B; 317/31, 317/123, 134, 154; 307/125, 130, 142, 94, 141.8

[56] References Cited

UNITED STATES PATENTS

| | | | |
|---|---|---|---|
| 2,874,376 | 2/1959 | Spenard | 317/154 X |
| 3,319,128 | 5/1967 | Nilssen | 317/154 X |
| 3,425,050 | 1/1969 | Tellerman et al. | 340/280 X |
| 3,718,839 | 2/1973 | Conti | 317/154 X |

*Primary Examiner*—John W. Caldwell
*Assistant Examiner*—William M. Wannisky
*Attorney, Agent, or Firm*—Robert E. Massa

[57] ABSTRACT

Apparatus for the prevention of theft of electrical appliances comprises an automatic electronic lock off system which may be activated in a particular manner after the appliance is connected to a source of electrical power, and which becomes deactivated when the appliance is disconnected from its source of power to cause the further disconnection in the appliance electrical circuit. The apparatus comprises essentially three components, a key-operated activator switch, a relay, and the appliance's own on-off switch, all connected with the appliance's own circuit leads in a particular manner. The key-operated activator switch is designed to be operated with its own individual key and may, if desired, be hid from view. Initially, the key-operated activator switch is briefly closed to complete a circuit with the coil of the relay. Activation of the relay closes a normally open switch in series with the appliance on-off switch to permit the appliance then to be operable. Consequently, disconnection of the appliance from its source of power causes deactivation of the relay and opening of the normally open switch. Then, if the appliance is subsequently plugged into its source of power, the appliance circuit will be capable of being completed only when the key-operated activator switch is again closed.

3 Claims, 1 Drawing Figure

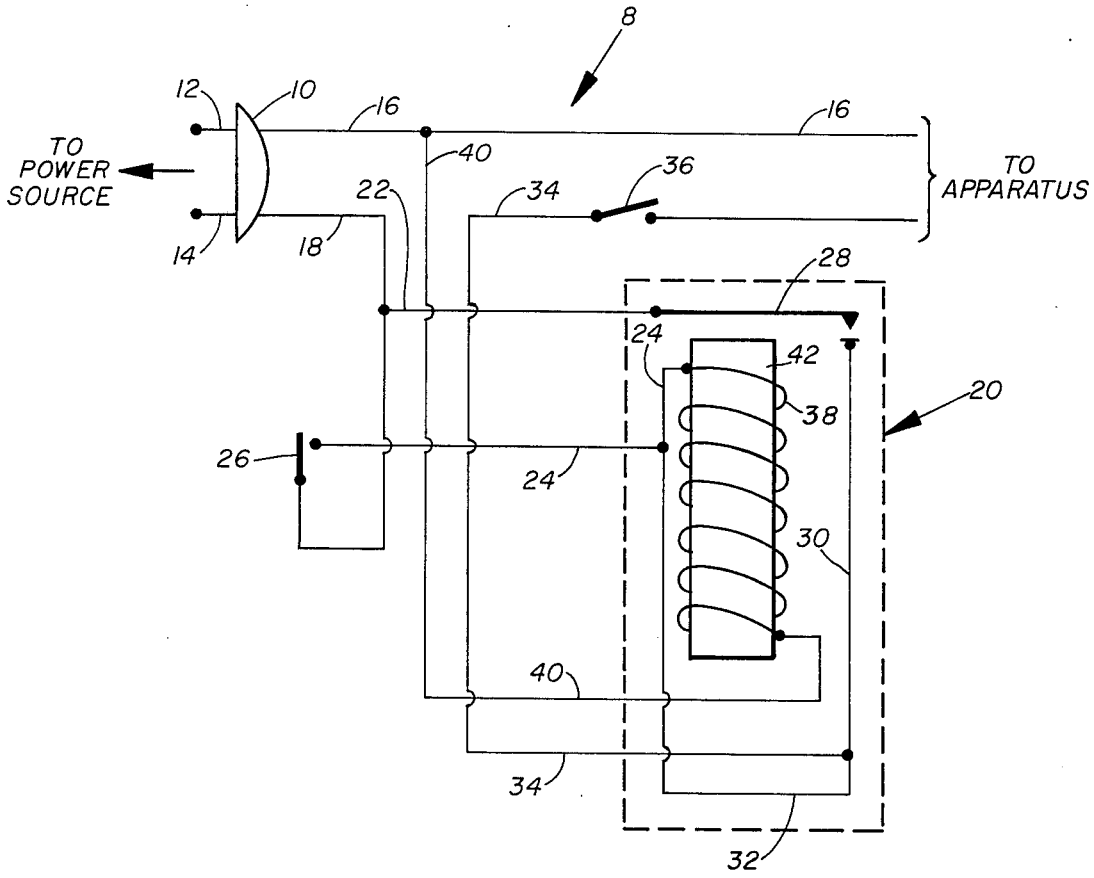
8
12
10
16
16
TO
POWER
SOURCE
40
36
TO
APPARATUS
22
34
14
18
28
24
42
20
38
26
24
30
40
34
32

AUTOMATIC ELECTRONIC LOCK OFF SYSTEM FOR AN APPLIANCE

BACKGROUND OF THE INVENTION

This invention relates to devices to discourage the theft of electrical appliances, such as television receivers or stereo components.

More particularly, this invention relates devices to discourage the theft of electrical appliances by reason of having a notice thereon that once the appliance is disconnected from its source of power it will be inoperative until special, undisclosed adjustments are made to the device.

Still more particularly, this invention relates to devices connected in circuit arrangement with the electrical circuit of an electrical appliance to permit the appliance to be operated after the appliance circuit is connected to a source of power and the device is activated, and to prevent the appliance from being operated after the appliance is disconnected from its source of power unless the device is activated.

Numerous anti-theft devices have been developed in the past. A few of the patents which describe such devices are as follows: King, U.S. Pat. No. 3,289,194; Tellerman, U.S. Pat. No. 3,425,050; Cones, U.S. Pat. No. 3,537,095; Fistell, U.S. Pat. No. 3,553,673; Whalen et al, U.S. Pat. No. 3,710,371; and Lowry U.S. Pat. No. 3,765,008.

The theft of television sets, stereo components, and other major electrical appliances from motels, hotels, and homes has been increasing greatly. The recognition by the public of this increase in crime has brought about the development of many types of anti-theft devices. The theft of electrical appliances from motels and hotels is particularly serious, and most of the anti-theft devices either incorporate alarm means within the appliance itself, or alarm means at a central location. The previous anti-theft alarm devices have been usually quite complex and, because of this complexity, were easily detected and made inoperative by the intended thief. Also, those devices which did include some type of alarm means, as in all the patent references cited above, usually included a battery in addition to the alarm means. And, they usually included some type of switching means, such as a relay, which activated the secondary circuit as soon as the condition of the appliance was changed, as by being disconnected from its primary source of electrical power or by being moved.

An alarm system, either one incorporated within the appliance or one situated at a central location, has the distinct disadvantage of disturbing other guests of the motel or hotel when the appliance is moved, even if the burglary is unsuccessful.

Most of these prior art devices are unsatisfactory and impractical because they are either too complicated to manufacture at a resonable price or are too difficult to maintain. Those systems which include a battery to operate the secondary circuit require constant surveillance by maintenance personnel in order to replace the batteries before they deteriorate with age. Obviously, if the battery has already deteriorated, the alarm device itself will not operate and the burglary is a simple matter.

SUMMARY OF THE INVENTION

Therefore, the primary object of my invention is to provide a burglary deterrent device which is safe and easy to use, efficient in operation, inexpensive, easy to manufacture, and easy to install.

Another object of my invention is to provide a burglary deterrent device which may be easily and quickly installed on many types of electrical appliances.

Still another object of this invention is to provide a burglary deterrent device which may be placed in an operative condition only by use of special means.

These and other objects of the invention will become apparent from the accompanying description and the drawing and attached claims which describe the invention as an automatic electronic lock off system for an appliance comprising means for connecting the appliance to a source of electrical power, relay means in series connection with the appliance and the means for connecting the appliance to a source of electrical power with the relay including a normally open switch, and activator switch means in series connection with the relay and the means for connecting the appliance to a source of electrical power, whereby brief closure of the activator switch means activates the relay means to close the normally open switch in series connection with the means for connecting the appliance to a source of electrical power.

The automatic electronic lock off system of my invention is a burglary deterrent device which may be quickly and easily connected in the electrical circuit of an electrical appliance such as a television receiver or stereo record or tape player component, but is not to be considered as limited to this type of appliance, and may be employed with various other electrical appliances. The primary component of my device is a relay which may be similar to one described as a Potter and Brumfield Relay, Catalog Number KA5AG, SPDT Relay having 10 Amp. contacts, and which may be supplied in various sizes ranging from 6 volts, 6 ohms to a 240 volt, 9,110 ohms specification. This relay means is then placed in series connection with the appliance and with the appliance plug-in cord. An activator switch is then placed in series connection with the relay and also with the appliance plug-in cord. The activator switch is normally made operative by some means not readily available to the intended burglar. By this, I mean that the activator switch may be either key-operated or operated by a combination lock. The relay component includes a normally open switch which is in series connection with the appliance plug-in cord and is in further series connection with the on-off switch of the appliance. Then, after the appliance is plugged into an electrical outlet, the key-operated activator switch is briefly closed to cause the relay to operate and the normally open switch of the relay to close. The key-operated activator switch may then be opened and the normally open switch of the relay will remain closed because the coil of the relay remains in series connection with the source of electrical power. At the same time, the on-off switch of the electrical appliance is in series connection with the source of electrical power and may then be operated in the normal manner.

However, if the electrical cord of the appliance is disconnected from the electrical outlet, as would be done by a burglar attempting to remove the appliance, the relay is immediately disconnected from the source of electrical power and the normally open switch is permitted to open, thereby breaking the electrical circuit from the source of electrical power to the on-off switch of the appliance. Even if the appliance is subsequently plugged into an electrical outlet again, the appliance cannot be operated until the activator switch is once again closed briefly.

BRIEF DESCRIPTION OF THE DRAWING

In the accompanying drawing:

The sole FIGURE is a schematic circuit diagram of an automatic electronic lock off system for an appliance according to my invention.

DESCRIPTION OF THE PREFERRED EMBODIMENT

An automatic electronic lock off system for an appliance according to this invention comprises means for connecting the appliance to a source of electrical power, relay means in series connection with the appliance and the means for connecting the appliance to a source of electrical power, the relay including a normally open switch, and activator switch means in series connection with the relay means and the means for connecting the appliance to a source of electrical power, whereby brief closure of the activator switch means activates the relay means to close the normally open switch in series with the means for connecting the appliance to a source of electrical power.

In the sole drawing, which is a schematic circuit diagram of an apparatus according to my invention, showing the manner in which my device is connected in the circuit of a conventional electrical appliance, I have designated my device generally by the numeral 8. A conventional male plug 10 of the appliance electrical cord has terminals 12 and 14 adapted to fit into a conventional electrical power source as indicated in the drawing and are further connected to leads 16 and 18 of the appliance cord. A relay 20, generally, as described above, is connected in series with the appliance by connection of lead 22 to lead 18 and connection of lead 24 to key-operated activator switch 26. Then, lead 22 is connected to switch 28 of relay 20 and the other contact of switch 28 is connected by lead 30 to both leads 32 and 34. Lead 32 is then connected to lead 24 as shown, and lead 34 is connected to the on-off switch 36 of the appliance. Lead 24 is connected to the coil 38 of relay 20 and the other end of coil 38 is connected to lead 440 which is in turn connected to lead 16 of the appliance cord.

The device of my invention is operated in the manner described above after the appliance is plugged into a source of power by the brief closing of key-operated switch 26 which causes current to flow through coil 38 establishing a magnetic field around armature 42 to cause switch 28 to close, after which switch 26 is opened. Closure of switch 28 allows current to continue flowing in the circuit whereby the appliance on-off switch 36 may be closed to operate the appliance. However, should the male plug 10 be removed from the power outlet, switch 28 opens and cannot be closed again until the appliance is plugged into another source of power and key-operated switch 26 is again briefly closed.

Since many different embodiments of this invention may be made without departing from the spirit and scope thereof, it is to be understood that the specific embodiments described in detail herein are not to be taken in a limiting sense, since the scope of the invention is best defined by the appended claims.

I claim:

1. An automatic electronic lock off system for an appliance comprising:

an appliance, means for connecting the appliance to a source of electrical power, relay means including a coil and a normally open switch, and activator switch means, the means for connecting the appliance to a source of electrical power, the normally open switch, and the coil are connected in series, the means for connecting the appliance to a source of electrical power, the normally open switch, and the appliance are connected in series, and the means for connecting the appliance to a source of electrical power, the activator switch means, and the coil are connected in series, whereby brief closure of the activator switch means activates the relay means to close the normally open switch to permit a current flow to the appliance and to permit a current flow to the coil so that the normally open switch may be held closed.

2. An automatic electronic lock off system for an appliance as described in claim 1 wherein the normally open switch is further in series connection with an on-off switch of the appliance and in series connection with the coil of the aforesaid relay.

3. An automatic electronic lock off system for an appliance as described in claim 2 wherein the activator switch means is a key operated switch.

* * * * *